United States Patent [19]

Chike

[11] Patent Number: 4,718,601

[45] Date of Patent: Jan. 12, 1988

[54] HEATING UNIT

[76] Inventor: Paul T. Chike, Rte. 3, Box 108B, Dover, Del.

[21] Appl. No.: 854,875

[22] Filed: Apr. 23, 1986

[51] Int. Cl.[4] ..... F24H 3/06; F24H 7/00

[52] U.S. Cl. ..... 237/16; 219/365

[58] Field of Search ..... 237/16, 17, 18; 219/365, 341, 369, 366, 359, 378; 126/101; 165/122

[56] References Cited

U.S. PATENT DOCUMENTS 2,602,875 7/1952 Behm ..... 237/16 X
3,681,567 8/1972 Boecher ..... 237/16 X
4,105,894 8/1978 Parks ..... 237/16 X
4,125,151 11/1978 Hays et al. ..... 237/16 X

*Primary Examiner*—Henry A. Bennet
*Attorney, Agent, or Firm*—Gilden & Israel

[57] ABSTRACT

An improved heating unit includes a water storage tank having an immersion heating element, with the water being pumped from the storage tank through the coils of a heat exchanger or condenser element. Ambient air is drawn over the coils and through a venturi transfer means to a hot air blower which then delivers the heated air to desired locations. The venturi duct between the heat exchanger and the blower insures a steady and efficient air flow over the condenser coils.

8 Claims, 3 Drawing Figures

HEATING UNIT

BACKGROUND OF THE INVENTION

1. Field of the Invention

The present invention relates to heating devices, and more particularly pertains to a hot water forced air circulation heater which is of a compact and efficient design.

2. Description of the Prior Art

Hot water forced air circulation heaters are known in the prior art. For example, reference is made to U.S. Pat. No. 3,567,905, which issued to Ferraro, et. al. on Mar. 2, 1971, wherein there is disclosed a hot water forced air circulation heater having a water storage tank, an electric immersion heater associated therewith, and a heat exchanger and blower assembly for removing the heat to a desired location. The blower assembly is positioned within an air intake section and includes an expanded duct which directs a flow of air over the heat exchanger assembly through which hot water is selectively directed. This design, which is typical of prior art constructions, results in a reduced rate of air flow once it leaves the blower unit due to the expanded construction of the duct. Accordingly, a substantial loss of efficiency is realized due to the inability of this unit to maintain a pressurized, rapid flow rate of air across the heat exchanger coils.

As such, it can be appreciated that there exists a substantial need for improvement in the design of hot water forced air circulation heaters, wherein increased air flow rate and pressure differential could be realized to increase heater efficiency, and in this respect, the present invention substantially fulfills this need.

SUMMARY OF THE INVENTION

In view of the foregoing disadvantages inherent in the known types of hot water forced air circulation heaters, the present invention provides an improved forced air circulation heater wherein increased air flow rate and pressure differential over heat exchanger coils is realized. As such, the general purpose of the present invention, which will be described subsequently in greater detail, is to provide a new and improved hot water forced air circulation heater which has all of the advantages of the prior art hot water forced air circulation heaters and none of the disadvantages. To attain this, the heater unit comprising the present invention includes a housing in which a hot water storage tank is positioned. An electric immersion heater is positionable within the hot water storage tank so as to heat the water therein, while a liquid circulation pump then directs the water flow in a closed cycle through the coils of a conventional heat exchanger or condenser unit. A switch and thermostat assembly is provided to control the water and air temperature, and the invention further includes an expansion and filler tank to compensate for unexpected water and gas expansion within the closed system.

The improvement of the present invention comprises the positioning of the blower assembly on a downstream side of the heat exchanger unit wherein air is drawn over the condenser coils to the blower fan assembly, as opposed to being blown in an opposite direction over the coils. This construction permits a duct assembly to be fashioned between the heat exchanger coils and the blower unit in a manner whereby the duct necks down to a much smaller diameter at its connection point to the blower. This provides a venturi effect, with the duct work then operating as a venturi means, thus to result in an increasing air flow rate and lowered pressure. Thus, heated air enters the blower unit and is directed outwardly therefrom into a conventional expanded duct work for deliverty to desired locations within a boat, camper, building, or the like.

There has thus been outlined, rather broadly, the more important features of the present invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions so far as they do not depart from the spirit and scope of the present invention.

It is therefore an object for the present invention to provide a new and improved hot water forced air circulation heater which has all the advantages of the prior art hot water forced air circulation heaters and none of the disadvantages.

It is another object of the present invention to provide a new and improved hot water forced air circulation heater which may be easily and efficiently manufactured and marketed.

It is a further object of the present invention to provide a new and improved hot water forced air circulation heater which may be efficiently and reliably installed and operated.

Even another object of the present invention is to provide a new and improved hot water forced air circulation heater which is of a durable and reliable construction.

Still another object of the present invention is to provide a new and improved hot water forced air circulation heater which operates to increase hot air flow over heat exchanger coils in a controlled and efficient manner.

Yet another object of the present invention is to provide a new and improved hot water forced air circulation heater which is characterized by a portable and lightweight construction, thereby to facilitate the installation and transporting thereof.

An even further object of the present invention is to provide a new and improved hot water forced air circulation heater which is susceptible of a low cost of manufacture with regard to both materials and labor, and which accordingly is then susceptible of low prices of sale to the consuming public, thereby making such hot water forced air circulation heater economically available to the buying public.

Still yet another object of the present invention is to provide a new and improved hot water forced air circulation heater which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other then those set forth above will become apparent when consideration is given to the following detailed description thereof. Such description makes reference to the annexed drawings wherein.

DESCRIPTION OF THE PREFERRED EMBODIMENT

Figure 1:
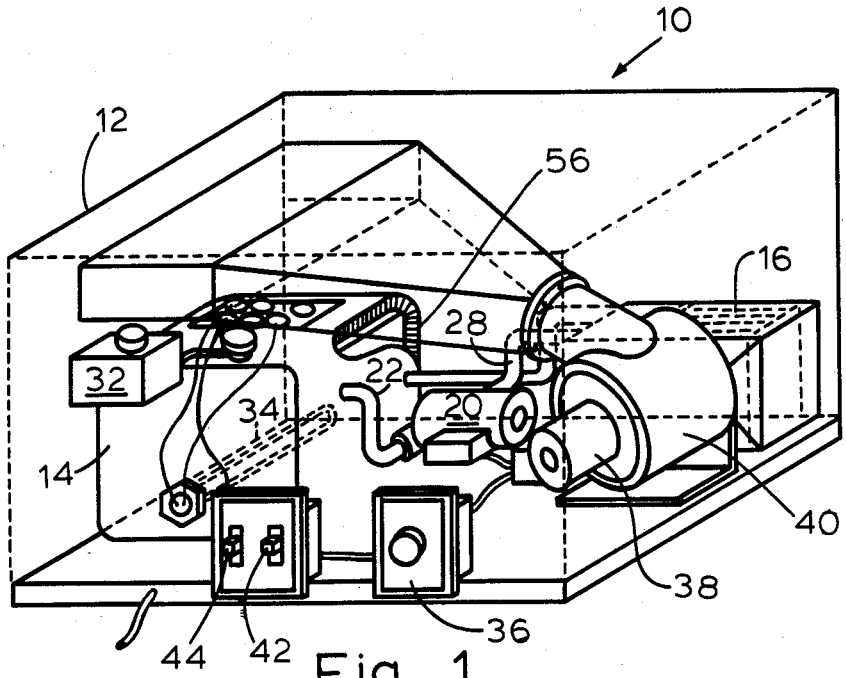
FIG. 1 is a perspective view of the hot water forced air circulation heater comprising the present invention.
Figure 2:
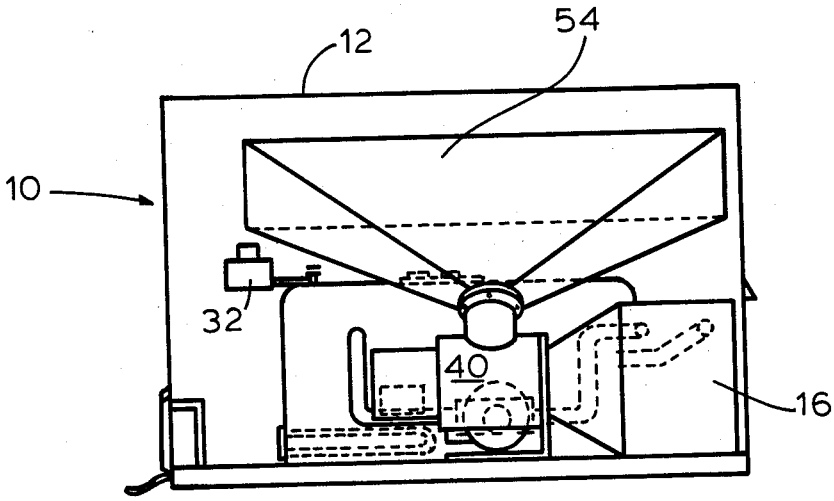
FIG. 2 is a side elevation view thereof.
Figure 3:
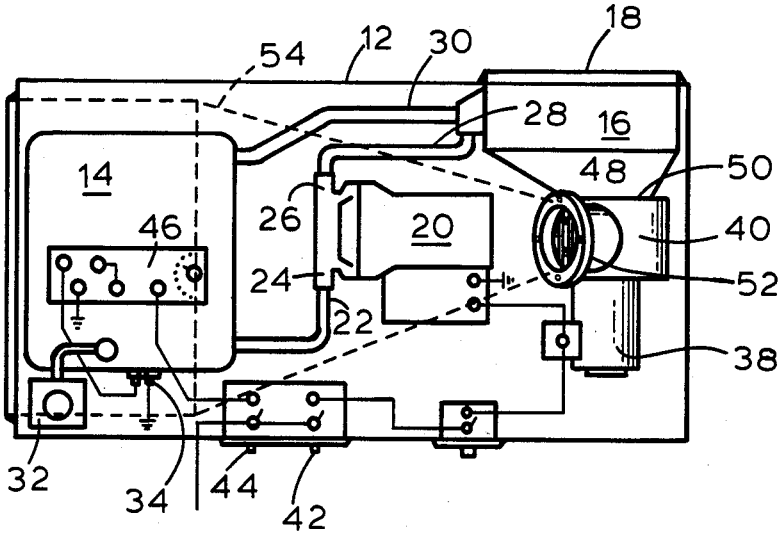
FIG. 3 is a top plan view thereof.

With reference now to the drawings and in particular to FIGS. 1–3 thereof, a new and improved hot water forced air circulation heater embodying the principles and concepts of the present invention and generally designated by the reference numeral 10 will be described. In this regard, the hot water forced air circulation heater 10 includes a housing 12, which is depicted substantially in phantom lines, with all of the operable components of the heater being contained therein. More specifically, a liquid storage tank 14, such as for storing water or the like, is fixedly secured within the housing 12 and is fluidly interconnected in a closed cycle to a conventional condenser or heat exchanger 16 also secured within the housing. The heat exchanger 16 includes an air intake portion 18 directed through the housing 12, whereby a flow of ambient air is permitted to move from an exterior location of the housing into the heat exchanger so as to pass over the heat exchange coils associated therewith.

A liquid circulation pump 20 is interconnected within the closed cycle liquid flow circuit and is operable to direct a continuing flow of liquid from the liquid storage tank 14 to the heat exchanger 16 and then back to the liquid storage tank. In this respect, a discharge conduit 22 is directed from the liquid storage tank 14 to the intake 24 of the pump 20, with a similiar conduit 28 being provided between the outlet 26 of the pump and the heat exchanger 16. Once the liquid has passed through the heat exchanger 16, a further conduit 30 is provided to fluidly direct the liquid from the heat exchanger back to the liquid storage tank 14.

Further illustrated in the drawings is a conventional expansion and filler tank 32 which both operates as the means by which additional liquid is added to the liquid storage tank 14 and the closed cycle system associated therewith, as well as providing a gas expansion tank to compensate for fluctuating system pressurization in a known and conventional manner. As to the manner of heating the liquid within the liquid storage tank 14, a conventional electric immersion heater 34 may be provided, such heater being similiar to the types utilized in commercial and residential hot water heaters. Also illustrated in the drawings is a conventional air temperature thermostat 36 electrically interconnected with an electric motor 38 utilizable to drive a forced air blower 40. A a thermostat switch 42 is provided for controlling the operation of the thermostat 36, with a further switch 44 providing manual operation of the aforementioned immersion heater 34. Also provided is a thermostatic assembly 46 which controls the temperature of the liquid in the liquid storage tank 14 by controlling the operation of the immersion heater 34.

A substantially novel and different feature of the hot water forced air circulation heater 10 comprising the present invention exists in the positioning of the heat exchanger or condenser 16 on the air intake side of the blower 40, as opposed to positioning the same on the air exhaust side of the blower as is done in conventional prior art heater units. As such, a venturi duct section 48 is provided between the heat exchanger 16 and the intake 50 of the blower 40 which, as most clearly illustrated in FIG. 3 of the drawings, is continually reduced in diameter from its point of attachment to the heat exchanger 16 to its point of attachment with the blower intake 50. Accordingly, a venturi effect is acheived as the air flows through the inlet 18 across the coils contained in the heat exchanger 16 to eventually enter into the blower 40. More specifically, and as is well known in the art, the decreasing space available for air flow results in an increase in air flow rate which in turn results in a decrease in sensed air pressure at the blower inlet 50. This decrease in air pressure at the blower inlet 50 results in an increase of air flow into the heat exchanger intake 18, as well as an increased pressure differential therein. Accordingly, a much more efficient heat exchanging air flow is realized over the coils of the heat exchanger 16.

With continuing reference to the drawings, it will be noted that the blower 40 has an outlet 52 to which a conventional air delivery duct 54 may be attached to facilitate hot air delivery from the air circulation heater 10 to a desired location. A final noteworthy feature of the present invention is the inclusion of an insulation layer 56 around the liquid storage tank 14 which, of course, increases the heat storage and retaining capacity thereof.

With respect to the manner of operation of the present invention, it can be appreciated that the hot water forced air circulation heater 10 is of a compact design so as to be easily transported and positioned where desired. A user thereof need only to supply 110 volt alternating current to the heater 10 and, through an adjustment of the air temperature thermostat 36, such current will operate to run the blower 40, the fluid circulation pump 20 and the immersion heater 34. Ambient air is drawn by the blower 40 through the air intake 18 across the heat exchanger coil 16, thereby to remove heat from the liquid contained within the coils, and the heated air realized thereby passes through the blower 40 into the heated air distribution plenum 54 for delivery to a desired location. The venturi section 48 of the air delivery system operates to move the air across the hot water coils contained in the heat exchanger 16 in a rapid and efficient manner with minimal heat loss.

Further, it is within the intent and purview of the present invention to have the heating unit 10 constructed so as to be separable into at least two parts. This would permit the heat exchanger 16 and blower 40 to be positioned in a desired use location having limited space, e.g., such as in boats, motor homes and camper trailers, with the heating tank and pump 20 being positioned in a second location. Any conventional conduit or tubing wrapped with insulation could then be utilized to transfer the heated liquid for any desired distance so as to pass the liquid through the heat exchanger 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as being illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hot water forced air circulation heater comprising:

housing means;

liquid storage means fixidly secured within said housing means;

heating means, said heating means comprising an electric immersion heater positioned within said liquid storage means and being operable to heat said liquid therein;

heat exchanger means being operable to receive a flow of heated liquid from said liquid storage means;

pump means for providing said flow of liquid from said liquid storage means to said heat exchanger means, said pump means further being operable to return said liquid to said liquid storage means after said liquid has passed through said heat exchanger means;

blower means operable to direct a flow of air over liquid containing coils in said heat exchanger means, thereby to heat said air passing thereover, said blower means being positioned on a downstream side of air flow across said heat exchanger means; and venturi means fluidly interconnecting said heat exchanger means with said blower means, said venturi means operating to accelerate and controllably direct air flow across said heat exchanger means in a controlled and efficient manner.

2. A hot water forced air circulation heater comprising:

a. housing means;

b. liquid storage means contained within said housing means;

c. heating means for operably heating a liquid in said liquid storage means;

d. heat exchanger means for receiving a flow of heated liquid from said liquid storage means;

e. pump means for directing said flow of heated liquid from said liquid storage means to said heat exchanger means and then back to said liquid storage means;

f. blower means for directing a flow of air to be heated through said heat exchanger means, said blower means being located on a downstream side of air flow through said heat exchanger means; and, g. duct means fluidly interconnecting said blower means with said heat exchanger means, said duct means comprising a fluid flow conduit of varying diameter, with a greater diameter portion being attached to an air exhaust side of said heat exchanger means and a lesser diameter portion being attached to an intake of said blower means, thereby to provide a venturi effect to air flowing through said heat exchanger means and being delivered to said intake of said blower means.

3. The hot water forced air circulation heater of claim 2, and further including air temperature thermostat means for controlling an operation of said heater.

4. The hot water forced air circulation heater as described in claim 3, and further including liquid temperature thermostat means for controlling a temperature of said liquid utilizable in said heater.

5. The hot water forced air circulation heater of claim 4, and further including an expansion and filler tank in fluid communication with said liquid storage means.

6. The hot water forced air circulation heater as described in claim 5, wherein said heating means comprises an electric immersion heater.

7. The hot water forced air circulation heater of claim 6, and further including a manually operable switch for said air temperature thermostat.

8. The hot water forced air circulation heater as described in claim 7, and further including a further manual switch for controlling electric power deliverable to said electric immersion heater.

* * * * *